US011426642B1

(12) United States Patent
Hamburger

(10) Patent No.: US 11,426,642 B1
(45) Date of Patent: Aug. 30, 2022

(54) ADJUSTABLE GOLF CLUB SHAFT

(71) Applicant: Edward Hamburger, Toms River, NJ (US)

(72) Inventor: Edward Hamburger, Toms River, NJ (US)

( * ) Notice: Subject to any disclaimer, the term of this patent is extended or adjusted under 35 U.S.C. 154(b) by 0 days.

(21) Appl. No.: 17/679,793

(22) Filed: Feb. 24, 2022

Related U.S. Application Data

(60) Provisional application No. 63/313,089, filed on Feb. 23, 2022.

(51) Int. Cl.
*A63B 60/28* (2015.01)
*A63B 53/14* (2015.01)
*A63B 53/04* (2015.01)

(52) U.S. Cl.
CPC ..... *A63B 60/28* (2015.10); *A63B 53/047* (2013.01); *A63B 53/0466* (2013.01); *A63B 53/0487* (2013.01); *A63B 53/14* (2013.01); *A63B 2053/0479* (2013.01)

(58) Field of Classification Search
CPC ..... A63B 53/14; A63B 60/28; A63B 60/10
See application file for complete search history.

(56) References Cited

U.S. PATENT DOCUMENTS

| | | | | |
|---|---|---|---|---|
| 2,129,068 | A | 9/1938 | Reach | |
| 5,374,064 | A | 12/1994 | Barber | |
| 6,394,909 | B1 | 5/2002 | Laibangyang | |
| 6,648,770 | B1 * | 11/2003 | Snyder | A63B 60/10 473/409 |
| 7,172,514 | B2 | 2/2007 | Benson | |
| 7,510,482 | B2 | 3/2009 | Benson | |
| 7,582,023 | B2 | 9/2009 | Hung | |
| 7,798,911 | B2 | 9/2010 | Gill | |
| 8,267,805 | B2 | 9/2012 | Johnson | |
| 8,425,344 | B2 | 4/2013 | Evans et al. | |
| 8,641,551 | B2 | 2/2014 | Johnson | |
| 8,740,720 | B2 | 6/2014 | Soracco et al. | |
| 8,814,718 | B1 | 8/2014 | Rollinson et al. | |

(Continued)

FOREIGN PATENT DOCUMENTS

| | | | |
|---|---|---|---|
| JP | 6340182 | B2 | 6/2018 |
| WO | 2002055157 | A1 | 7/2002 |

OTHER PUBLICATIONS

JP6340182B2, EPO Machine translation, Publication JP2015080695, Jun. 6, 2018.

*Primary Examiner* — Michael D Dennis
(74) *Attorney, Agent, or Firm* — MacMillan, Sobanski & Todd, LLC

(57) ABSTRACT

A length adjustable golf club includes a club head attached to a shaft at a lower end. A length adjusting kit includes a shaft insert that attaches to the shaft at an upper end. The shaft insert includes a coupling port that accepts one of an extension block or a grip adapter. To provide length adjustments of the overall club length, one or more extension blocks may attached between the shaft insert and the grip adapter. A grip assembly having a reinforcing sleeve connects to the grip adapter and extends over the shaft and any extension blocks. The grip assembly couples to the shaft through a grip adapter and grip coupling. The grip adapter and grip coupling are axially moveable prior to securement with a retaining fastener. The grip coupling may be rotationally constrained or rotationally adjustable relative to the grip adapter.

17 Claims, 9 Drawing Sheets

(56) References Cited

U.S. PATENT DOCUMENTS

| | | | | |
|---|---|---|---|---|
| 8,852,019 | B2 * | 10/2014 | Evans | A63B 53/10 473/299 |
| 10,500,454 | B2 | 12/2019 | Barker et al. | |
| 10,525,316 | B2 | 1/2020 | Barker et al. | |
| 10,987,559 | B1 | 4/2021 | Hamburger | |
| 2002/0091012 | A1 * | 7/2002 | Evans | A63B 60/22 473/316 |
| 2004/0116197 | A1 | 6/2004 | Benson | |
| 2009/0270197 | A1 | 10/2009 | Holtzman | |
| 2010/0184530 | A1 * | 7/2010 | Johnson | A63B 69/3685 473/409 |
| 2012/0258817 | A1 | 10/2012 | Beach et al. | |
| 2013/0109488 | A1 | 5/2013 | Evans | |
| 2014/0121031 | A1 | 5/2014 | Aguinaldo et al. | |
| 2015/0306481 | A1 | 10/2015 | Knutson et al. | |
| 2019/0151730 | A1 | 5/2019 | Trulaske et al. | |

* cited by examiner

ADJUSTABLE GOLF CLUB SHAFT

CROSS-REFERENCE TO RELATED APPLICATIONS

This application claims the benefit of U.S. Provisional Application No. 63/313,089, filed Feb. 23, 2022, the disclosure of which is incorporated herein by reference in its entirety.

BACKGROUND

Golf clubs are typically manufactured in discrete lengths, varied based on the associated club head, to provide a proper fit for different users. For young golfers and particularly children, the club length tends to be a compromise between a proper fit for their stance and the economics associated with outgrowing a fixed length golf club. Particularly in their formative, initial years of play club lengths may need to be changed frequently in order for them to develop good swing characteristics. If an ill-fitting club is used, their play and feel for the game suffers and they may lose interest. For experienced golfers, it may be desirable to vary club lengths when experimenting with different head configurations or to fine tune their swing or other parameters when they address the ball. However, re-shafting or replacing clubs becomes expensive. Known length adjustable clubs are either cumbersome and weighty or prone to excessive deflection and stress at extension connection points. Excessive deflections affect both the striking force applied to the golf ball and the orientation of the club striking face to the desired ball striking area, i.e., the "sweet spot." Additionally, distribution of the weight of certain extension devices may be as much of an impediment to accurate swing consistency than an ill-fitting club length. Since the accuracy and consistency of a golf swing is facilitated by a shaft with a controlled and consistent stiffness and weight distribution along the shaft length, there is a need to permit the club length to be varied yet maintain a lower and consistent shaft weight over as much of the shaft length as possible.

Golf regulations further require that any modifications to shaft configurations be made prior to play commencing, and the fitment between the club components must be secured and controlled. In securing a length adjustable grip configuration, a separate locking element such as a locking bolt is provided to create the locked connection between components. The assembled club components are not to be usable for play without the locking element in place. The attachment of the grip and length adjustment feature also needs to be free from looseness and provide the correct indexing of the grip to the club face. Thus, it would be beneficial to provide a golf club having an adjustable club length where the fitment between components is firm, oriented correctly, and retained by a suitable locking mechanism. It would also be beneficial to provide a golf club where proper attachment between the shaft and grip is readily discernable, repeatably and reliably reassembled, and easily secured. It would further be desirable to provide a length adjustable club that is inexpensive and easy to vary the club length yet retains a solid feeling during swing and ball contact events.

SUMMARY OF THE INVENTION

An adjustable golf club comprises a club head, a shaft, and a grip assembly. In certain embodiments, the grip assembly of the adjustable golf club includes a reinforcing sleeve that extends over a length extension of the grip assembly. The shaft is a hollow, tubular member having a shaft insert fixed to an inner surface of the shaft. The shaft insert includes a coupling port that receives a securing rod. In one embodiment, the shaft insert is adhesively bonded to the inner surface of the shaft. In another embodiment, the shaft insert is mechanically attached to the inner surface of the shaft. In certain aspects of the invention where length adjustment of the distance between the grip assembly and the club head is desired, at least one extension block is coupled between the shaft insert and a grip adapter. The extension block includes a through-bore that passes over a securing rod or a slot that permits the extension block to be placed around the securing rod between the shaft insert and the grip adapter.

The grip adapter is configured to provide a torsionally rigid and axial slip fit connection of the grip assembly to the shaft. The torsional rigidity of the grip adapter to shaft connection may be provided by torque resistive profile such as a spline member or may be provided by a locking and retaining member such as a threaded fastener. The grip adapter may provide a positional indexing of a grip cover to the club head. A retaining fastener, such as a retaining nut and threaded shaft structure, secures the grip adapter and any extension blocks to the shaft adapter. A locking element secures the grip assembly to the grip adapter and any length extension elements. The reinforcing sleeve extends over any installed extension blocks and over at least a portion of the shaft insert. In certain embodiments, the reinforcing sleeve also extends over the shaft to provide additional support and stability to the connections. The reinforcing sleeve includes an open proximal end, a tubular mid-section, and a distal end that accommodates the locking element. The locking element is threaded into the retaining nut or alternatively into a threaded bore of the securing rod. The reinforcing sleeve may be a single piece tubular member or a two piece member, where the distal end includes an attachment bore to secure the grip assembly to the shaft. The reinforcing sleeve is configured to carry a grip cover. The outer grip cover is applied over an outer surface of the reinforcing sleeve. In one embodiment, the outer grip cover is molded over the outer surface of the reinforcing sleeve. In an alternative embodiment, the outer grip cover is adhesively attached to the outer surface of the reinforcing sleeve.

The retaining nut is fastened to or includes a threaded rod portion that may extend through any number of length extension blocks (or no extension blocks) and fastens to a threaded bore of a shaft adapter. The retaining nut includes a bore, slot or outer structure configured as a torque transmitting profile to permit tightening of the nut against the grip adapter. The grip adapter is secured against the shaft adapter and any intervening extension blocks to form a solid attachment of the shaft to the grip assembly. In certain embodiments, the grip adapter may have a torque transmitting profile that engages a complementary profile within a grip assembly. In other embodiments, the grip adapter has a generally smooth, cylindrical profile that permits the grip assembly to be indexed relative to a club head striking face and precisely oriented by marking indicia.

An adjustable golf club includes a club head that defines a striking face and is attached to a shaft having a shaft insert supporting a grip adapter. The grip adapter defines a grip adapter profile. A grip assembly has a reinforcing sleeve and a grip coupling, where the grip coupling defines a complementary and mating profile with the grip adapter profile such that when mated the grip coupling is configured to be axially moveable relative to the grip adapter. A fastener restrains axial movement of the grip coupling relative to the grip adapter such that the grip assembly is configured to be removably secured to the grip adapter. In an embodiment of the adjustable golf club, the grip adapter profile is a torque resistive profile and may be configured as one of a hexagon, a square, a toothed spline, or a lobed spline. In an aspect of the invention, the shaft insert includes a coupling port that engages a securing rod. The securing rod extends through the grip adapter and terminates in a retaining nut that fixes the grip adapter to the shaft insert. The club head of the adjustable golf club may be configured as one of a driver, a fairway wood, an iron, a pitching wedge, a sand wedge, or a lob wedge.

In another embodiment of an adjustable golf club, a club head that defines a striking face and is attached to a shaft having a shaft insert supporting a grip adapter. The grip adapter defines a grip adapter profile that permits an angular indexing of the grip assembly relative to the striking face. A grip assembly has a reinforcing sleeve and a grip coupling, where the grip coupling defines a complementary and mating profile with the grip adapter profile such that, when mated, the grip coupling is configured to be axially moveable relative to the grip adapter. In one aspect, the complementary and mating profile is a generally smooth and cylindrical outer diameter. A fastener restrains axial movement of the grip coupling relative to the grip adapter such that the grip assembly is configured to be removably secured to the grip adapter. The grip assembly includes a grip cover having a handhold indicator area, and wherein one of the reinforcing sleeve or a grip cover includes a plurality of indicia to align the handhold indicator area relative to the striking face. The shaft includes a head locating reference that is aligned with the striking face and positioned proximate to at least one of the plurality of indicia. The club head of the adjustable golf club may be configured as a putter head.

In an aspect of either or both of the above-referenced embodiments of the adjustable golf club, at least one extension block is disposed over the securing rod and retained between the grip adapter and the shaft insert. In a further aspect, the shaft insert includes a counterbore configured to house at least a portion of the retaining nut. In another aspect, the reinforcing sleeve includes a stop that abuts an end face of the grip adapter. A retaining washer cooperates with the fastener to restrain axial movement of the grip coupling relative to the grip adapter. In certain embodiments, the retaining washer may be integrally formed with the reinforcing sleeve. In yet another aspect of the embodiments described herein of the adjustable golf club, the grip assembly may be a first grip assembly supporting a first grip cover and a second grip assembly supporting a second grip cover is configured to be interchangeable with the first grip assembly.

In another embodiment of an adjustable golf club, a club head that defines a striking face and is attached to a shaft having a shaft insert supporting a grip adapter. The grip adapter defines a grip adapter profile. A grip assembly has a reinforcing sleeve and a grip coupling, where the grip coupling defines a complementary and mating profile with the grip adapter profile such that when mated the grip coupling is configured to be axially moveable relative to the grip adapter. A fastener restrains axial movement of the grip coupling relative to the grip adapter such that the grip assembly is configured to be removably secured to the grip adapter. The grip adapter includes a counterbore and the grip adapter profile is a torque resistive profile, the shaft insert includes a coupling port that engages a securing rod, the securing rod extending through the grip adapter and terminating in a retaining nut, the retaining nut seating within the counterbore to secure the grip adapter to the shaft insert, the fastener engaging the retaining nut.

A method of assembling a grip assembly onto an adjustable golf club comprises the steps of providing a shaft having a club head attached to a distal end and a shaft insert secured to a proximal end. A retaining nut is provided and secured to a securing rod. A grip connector having a torque transmitting profile is positioned against the shaft insert and the securing rod is inserted through the grip connector. The securing rod is threaded into the shaft insert and the retaining nut tightened against the grip connector. The grip assembly is provided and includes a reinforcing sleeve attached to a grip connector having a mating torque transmitting profile, a retaining washer, and a grip cover attached over the reinforcing sleeve. The grip assembly torque transmitting profile is axially inserted into the mating torque transmitting profile of the grip connector. A fastener is inserted through the retaining washer and into engagement with the retaining nut.

Various objects and advantages of the adjustable golf club shaft extension will become apparent to those skilled in the art from the following detailed description of the preferred embodiment, when read in light of the accompanying drawings.

DETAILED DESCRIPTION OF THE INVENTION

Figure 1:
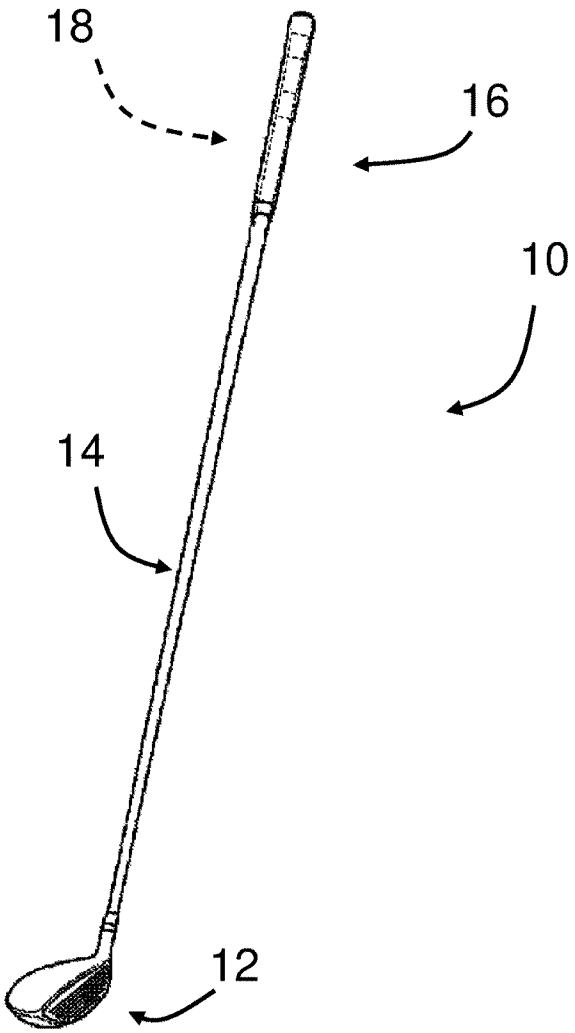
FIG. 1 is a perspective view of an adjustable golf club in accordance with the invention.

Referring now to FIG. 1, an adjustable golf club (hereafter "golf club") is shown generally at 10. While shown and described in the context of a golf club configured as a driver, the invention is applicable to any golf club, such as a putter, an iron, a wedge, a sand wedge, a chipping wedge, a hybrid club or any other form of club used in the game of golf. The golf club 10 includes a head 12, a shaft 14, and a grip assembly 16. The head 12, as indicated above, may be a head configured for use in any type of golf club. In the illustrated embodiment, the head 12 is fixed to the shaft 14 in a conventional manner, though the head or any of its parts may be configured as removable. The shaft 14 is a generally hollow, tubular member formed from any suitable material such as steel, aluminum, titanium, carbon fiber, composite, or other materials. Alternatively, the shaft 14 may be solid or have a solid core of a separate material.

Figure 6:
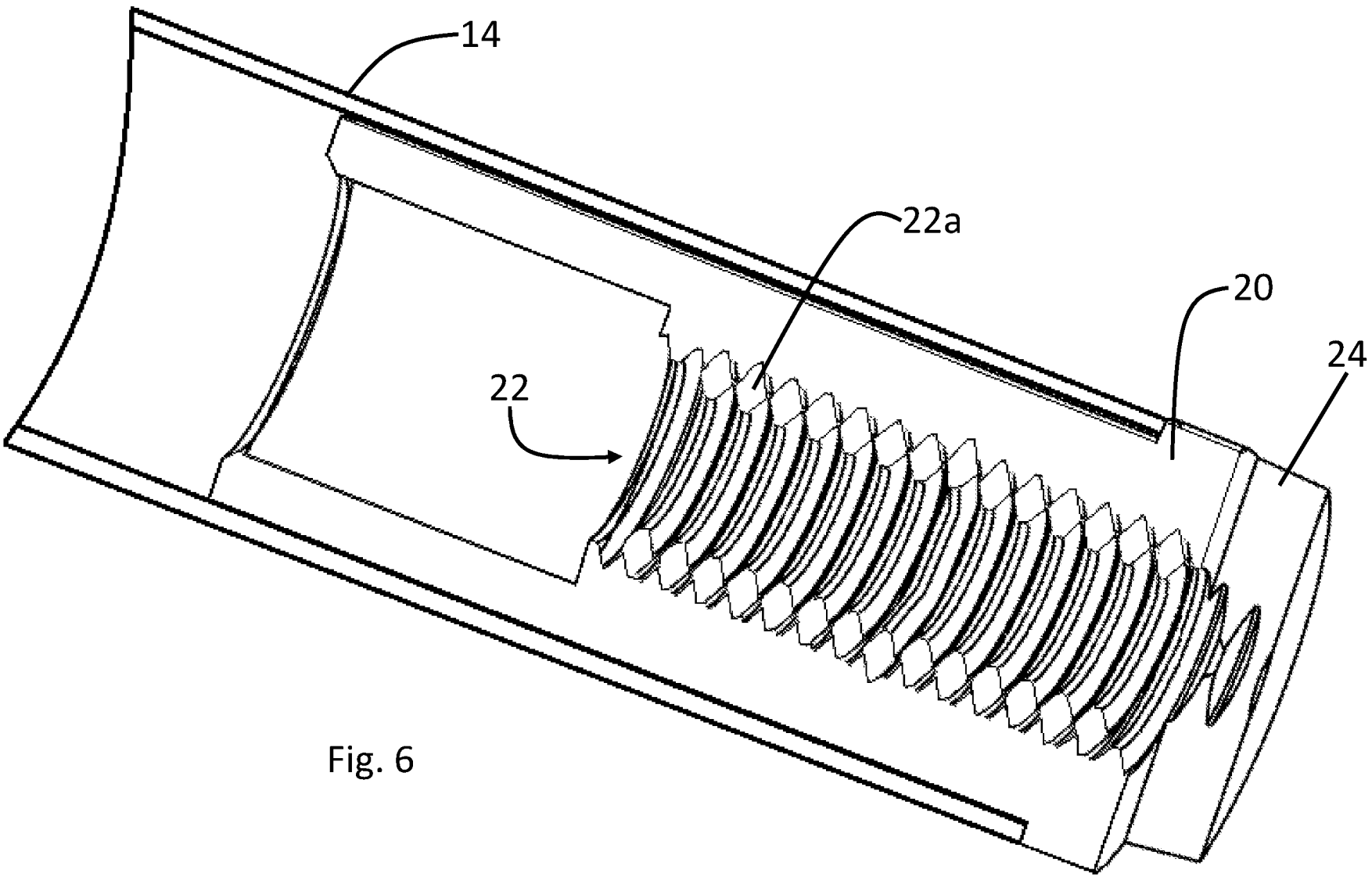
FIG. 6 is a cross-sectional view of an embodiment of a shaft insert and shaft assembly of the golf club of FIG. 1.
Figure 7C:
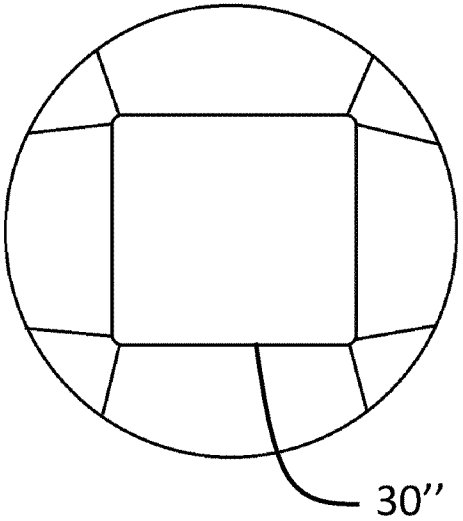
FIGS. 7A-7C are end view, schematic illustrations of exemplar spline forms for the grip adapter of FIG. 5A.
Figure 7B:
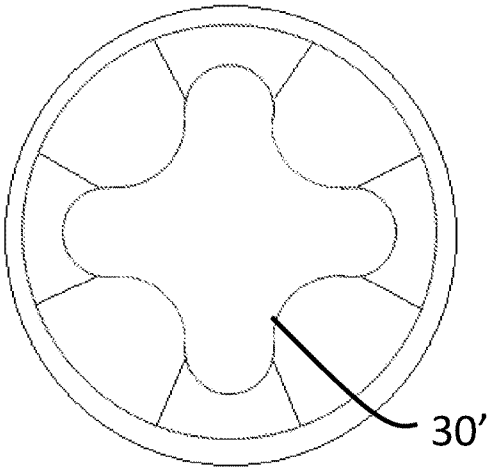
Figure 7A:
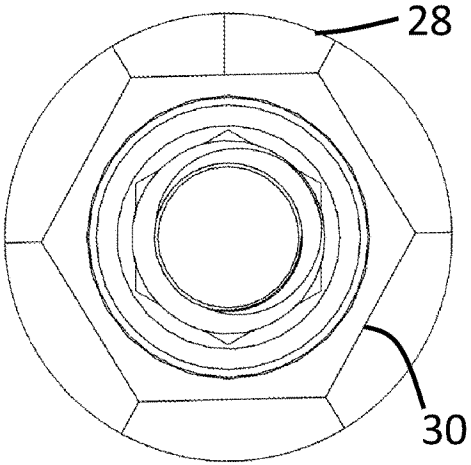
Figure 8B:
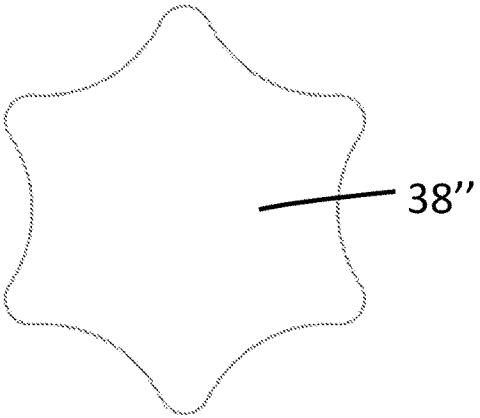
FIGS. 8A-8B are end view, schematic illustrations of exemplar wrench heads of the retaining nut and also alternative, exemplar spline forms for the grip adapter of FIG. 5A.
Figure 8A:
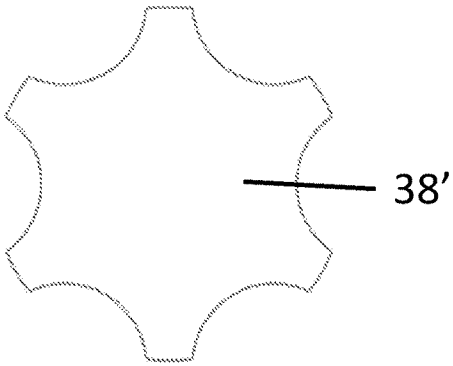

A length adjustment kit 18 includes a shaft insert 20 that is attached to the shaft 14. In the illustrated embodiment of FIGS. 1 and 6, the shaft insert 20 is attached to the shaft inner diameter. In one embodiment, the shaft insert 20 has an outer surface that is adhesively bonded to the shaft inner diameter. Alternatively, the shaft insert may be configured as a cup that locates and attaches to the shaft outer diameter. The outer surface of the shaft insert 20 may be smooth, knurled, serrated, or any surface that facilitates fixed attachment to the shaft 14. Alternatively, the shaft insert 20 may be mechanically coupled to, welded to, or integrally formed with the shaft. The shaft insert 20 includes a coupling port 22, illustrated as a threaded bore, and a retaining slot 24, illustrated as a straight sided slot, or alternatively a dovetail slot, formed on an outer face of the shaft insert. The coupling port 22 may have any type of connection feature, threaded, tapered, quick release, and the like, that can accept and retain a securing rod 26. In the illustrated embodiment, the coupling port 22 may optionally include a secondary threaded insert 22*a*, such as a Helicoil® brand screw locking wire insert, conventional screw thread inserts or other thread-form inserts. As illustrated, the securing rod 26 is a threaded member that engages the coupling port 22 and extends through a grip adapter 28. The grip adapter 28 includes a torque transmitting and grip orienting outer profile, shown as a spline 30 that is configured as a hexagonal spline form shown in FIG. 7A. Any torque transmitting and grip orienting outer profile may be used, including conventionally-toothed spline forms and alternative spline profiles 30' and 30" shown in FIGS. 7B and 7C and general examples of profiles 38' and 38" in FIGS. 8A-8B as detailed examples. The securing rod 26 extends through a bore 32 and a counterbore 34 in the grip adapter 28 in a slip-fit manner. The splines 30 permit the grip assembly 16 to be oriented onto the shaft 14 relative to the club head 12 and resist twisting or torsional movements. Axial movement of the grip adapter 28 is contained by a retaining nut 36.

The retaining nut 36 includes a threaded bore that is mated and secured to one end of the securing rod 26. Alternatively, the securing rod 26 and the retaining nut 36 may be a singular component. The retaining nut 36 may also be configured with threaded inserts if so desired. The securing rod 26 may include an unthreaded shoulder 26*a* defining a first section of threads that engage the retaining nut 36 and a second threaded section that is configured to accept one or more extension blocks and engage the shaft insert 20. The shoulder 26*a* permits a portion of the threads of the retaining nut 36 to remain accessible to accept a grip assembly locking element, as will be described below. A tightening end or wrench head 38 of the grip adapter 28 is illustrated as a female, hexagonal bore that accepts an Allen wrench or other suitable tool to tighten the retaining nut on the securing rod 26 and further secure the lengthening elements together against the shaft insert 20. Alternative wrench head configurations, such as the Torx® brand fastener profiles 38' and 38" shown in FIGS. 8A and 8B, or any other profile such as a socket wrench square drive may be used if desired. The outer diameter of the retaining nut 36 is a clearance fit within the counterbore 34.

Figure 2:
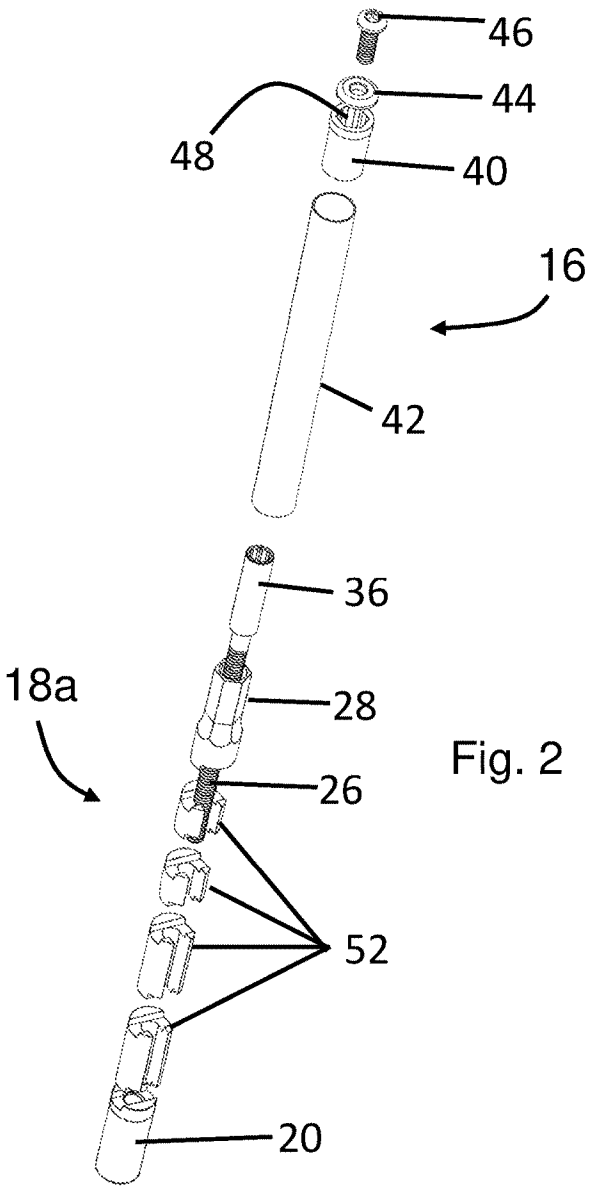
FIG. 2 is an exploded view of an embodiment of a grip assembly and length extension assembly of the adjustable golf club of FIG. 1.
Figure 3:
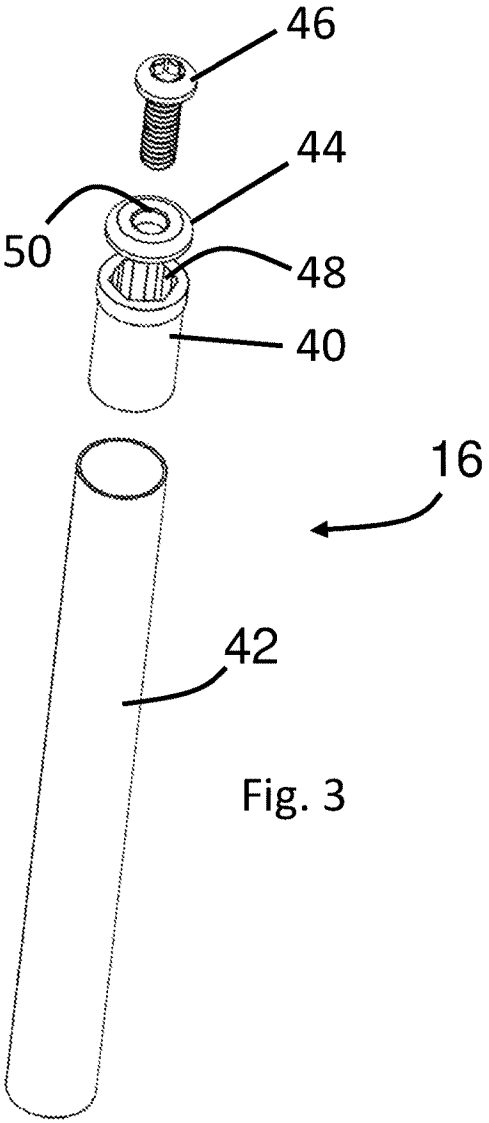
FIG. 3 is an enlarged, exploded view of the grip assembly of FIG. 2.
Figure 5A:
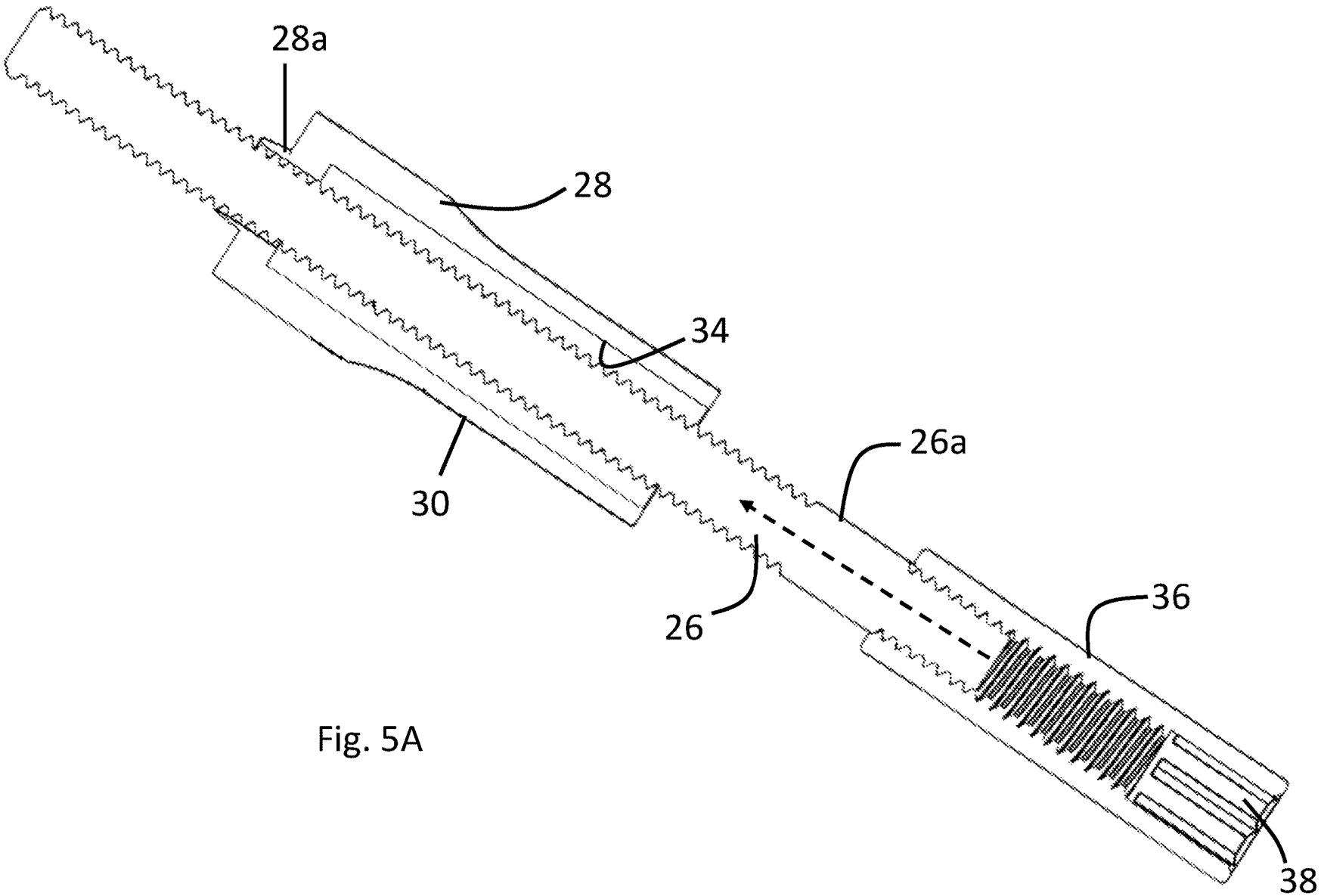
FIG. 5A is a cross sectional view of the grip adapter, retaining nut, and securing rod of FIGS. 4A and 4B.
Figure 5B:
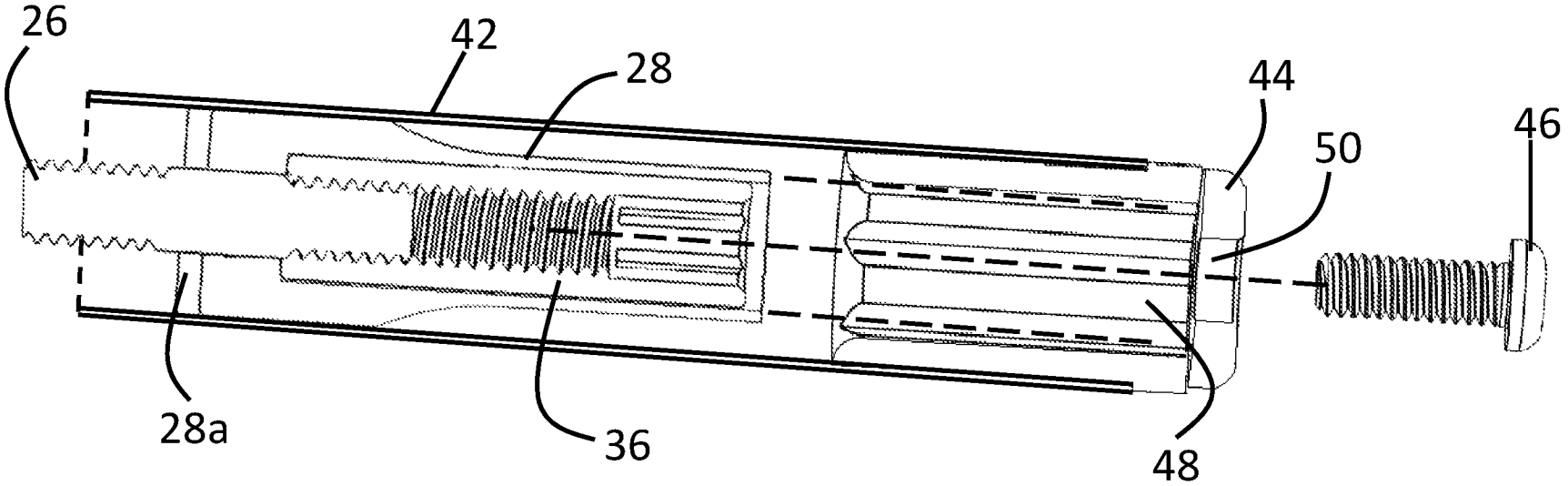
FIG. 5B is an enlarged, exploded view, in cross-section, of the assembled grip adapter and retaining nut of FIG. 5A and a portion of a grip assembly and locking element positioned for installation.
Figure 5C:
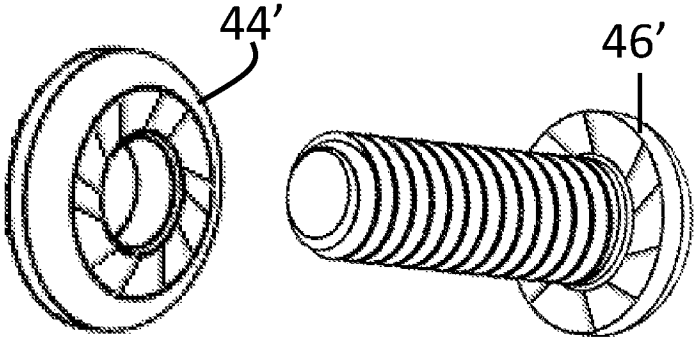
FIG. 5C is an enlarged, exploded view of an alternative locking element structure of FIG. 5B.

Referring now to FIGS. 2, 3A, and 3B, there is illustrated the grip assembly 16 comprising a grip coupling 40, a reinforcing sleeve 42, a retaining washer 44, and a grip assembly locking element 46, illustrated as a threaded fastener such as a bolt or screw. The grip coupling 40 may be formed as a cylindrically shaped member open at both ends or may be a closed cup-shaped element having the retaining washer 44 formed as an integral member. The grip coupling 40 may be fixed to the reinforcing sleeve 42 or may be integrally formed therewith. In certain embodiments, the grip coupling 40, reinforcing sleeve 42, and retaining washer 44 may be formed as a single piece structure. As shown in FIG. 9B, a lock washer 46*a* may be provided to prevent loosening of the connection between the locking element 46 and the threads of the retaining nut 36 or 102. The lock washer 46*a* may be any type of locking component that resists fastener loosening such as a split washer, star washer, nylon patch, or torque-prevailing thread design. Alternatively as shown in FIG. 5C, the locking feature may be integrated into mating surfaces of washer 44' and under the head of fastener 46'. A grip cover, similar to a conventional grip cover or grip cover 144 shown in FIG. 10B, may be molded over the grip assembly 16 or bonded thereto in a conventional manner. Any variety of grip covers 144 may be provided in accordance with the disclosure and attached to individual reinforcing sleeves 42 to permit interchange of grips for a variety of purposes. For example, a golfer may wish to install a practice or training grip on a club which is set at the desired length, to help fine tune aspects of their swing and switch to another type of grip for playing their rounds. Alternatively, golfers may desire to have grips of different thicknesses or variations in compliance and/or applied to different clubs. For example, a golfer may desire one type of grip for a driver and other styles for irons or wedges.

The grip coupling 40 includes a complementary and mating spline profile 48 to the spline profile 30 of the grip adapter 28. The spline fit between the grip coupling 40 and the grip adapter 28 is configured as a slip fit and may include clearance absorbing structures such as nylon patches or strips or a coating to prevent looseness yet permit axial movement prior to securement with the grip assembly locking element 46. As shown in FIG. 5B, the grip coupling 40 is affixed to the reinforcing sleeve 42 and slides over the spline 30 of the grip adapter 28. The threaded portion of the bolt 46 extends through the aperture 50 of the retaining washer 44 and the bolt head clamps against the surface or the washer. Alternatively, the aperture 50 may include a counterbore (not shown) to permit the bolt head to be recessed or flush with the surface of the washer.

Figure 4B:
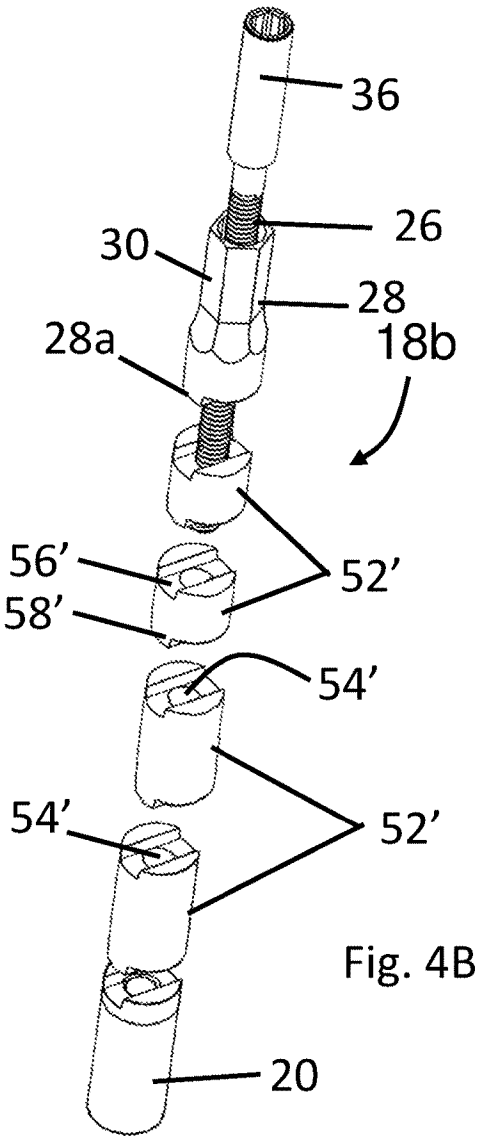
FIG. 4B is an enlarged, exploded view of an alternative embodiment of a length extension assembly having cylindrical extension blocks.
Figure 4A:
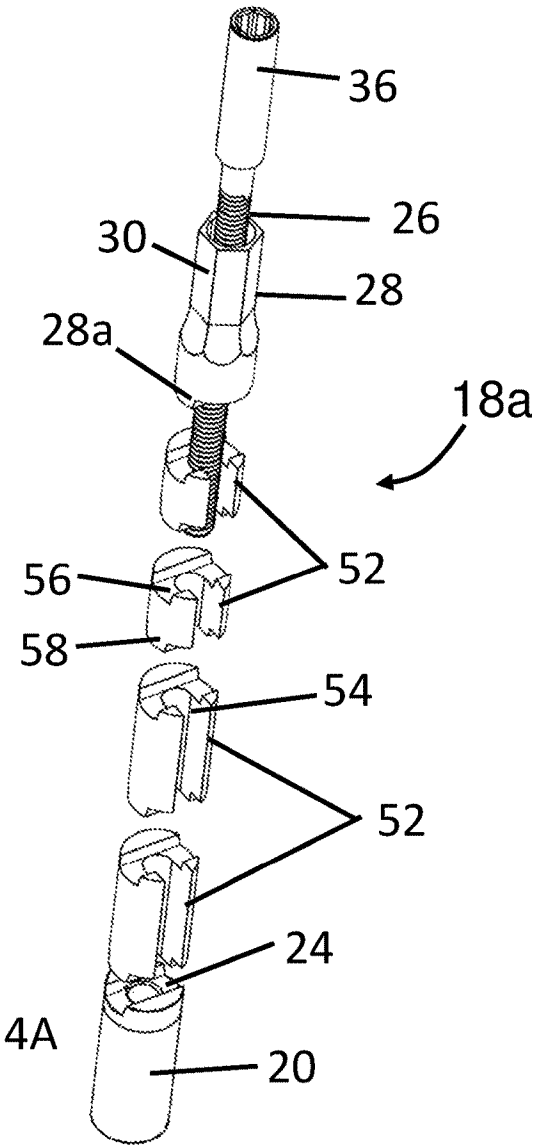
FIG. 4A is an enlarged, exploded view of the length extension assembly of FIG. 2.

Referring again to FIG. 4A, at least one extension block 52 is provided to adjust the length of the club 10. The extension blocks 52 are similarly structured but with different overall lengths so that a variety of length adjustments may be made by selecting the appropriate number and mix of blocks. The extension blocks 52 have an open slot 54 formed into the block to facilitate removal or addition of blocks around the securing rod 26 without the need to completely disassemble the length adjustment kit 18. The blocks have a retaining slot 56 at one end and a retaining boss 58 at an opposite end. The retaining boss 58 is configured to mate with retaining slot 24 of the shaft insert 20 or retaining slots 56 of other extension blocks 52. The grip adapter 28 likewise has a mating retaining boss 28*a* that engages with corresponding retaining slots 24 or 56. As shown in FIG. 4B, extension blocks 52' may be similarly configured with retaining slots 56' and retaining bosses 58' but where the open slot 54 is a closed through-bore 54'. In another alternative configuration, the retaining slots and bosses 56, 56' and 58, 58' may be eliminated. The extension blocks 52 or 52' may be formed from any material, such as steel, aluminum, titanium, carbon fiber, composite, or other materials.

In use, the locking element 46 may be removed from the retaining nut 36 and the grip assembly 16 pulled apart from engagement with the grip adapter 28. A wrench, such as an Allen wrench, is inserted into the wrench head 38 of the retaining nut 36 and loosened relative to the securing rod 26. Alternatively, the securing rod 26 may be loosened relative to the shaft insert 20. The retaining nut 36 is loosened and the securing rod 26 extended sufficiently to permit the grip adapter 28 to be separated from the shaft insert 20. One or more extension blocks 52 or 52' are selected to achieve the desired length adjustment to the club 10 and slipped over the securing rod 26. The retaining bosses and slots are aligned and mated to stabilize and secure the lengthening kit elements together. The bosses and slots 24, 28*a*, 56, 56' and 58, 58' are also positioned to maintain the orientation and index of the grip to the club head. The retaining nut 36 is tightened against the grip adapter 28 to thread the securing rod into the shaft insert 20 and compress the lengthening kit elements together. Once the lengthening kit is compressed, the grip coupling 40 and reinforcing sleeve 42 as an assembled component of the grip assembly 16 is inserted onto the spline 30 of the grip adapter 28. The locking bolt 46 is threaded into the retaining nut 36 to secure the grip assembly 16 to the shaft 14.

Figure 9A:
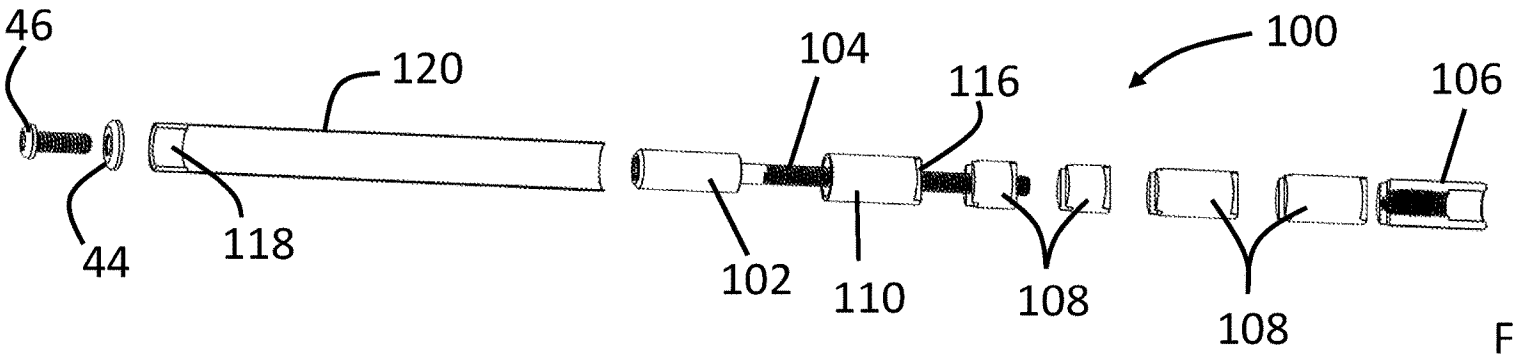
FIG. 9A is an exploded view of another embodiment of an adjustable golf club in accordance with the invention.
Figure 9B:
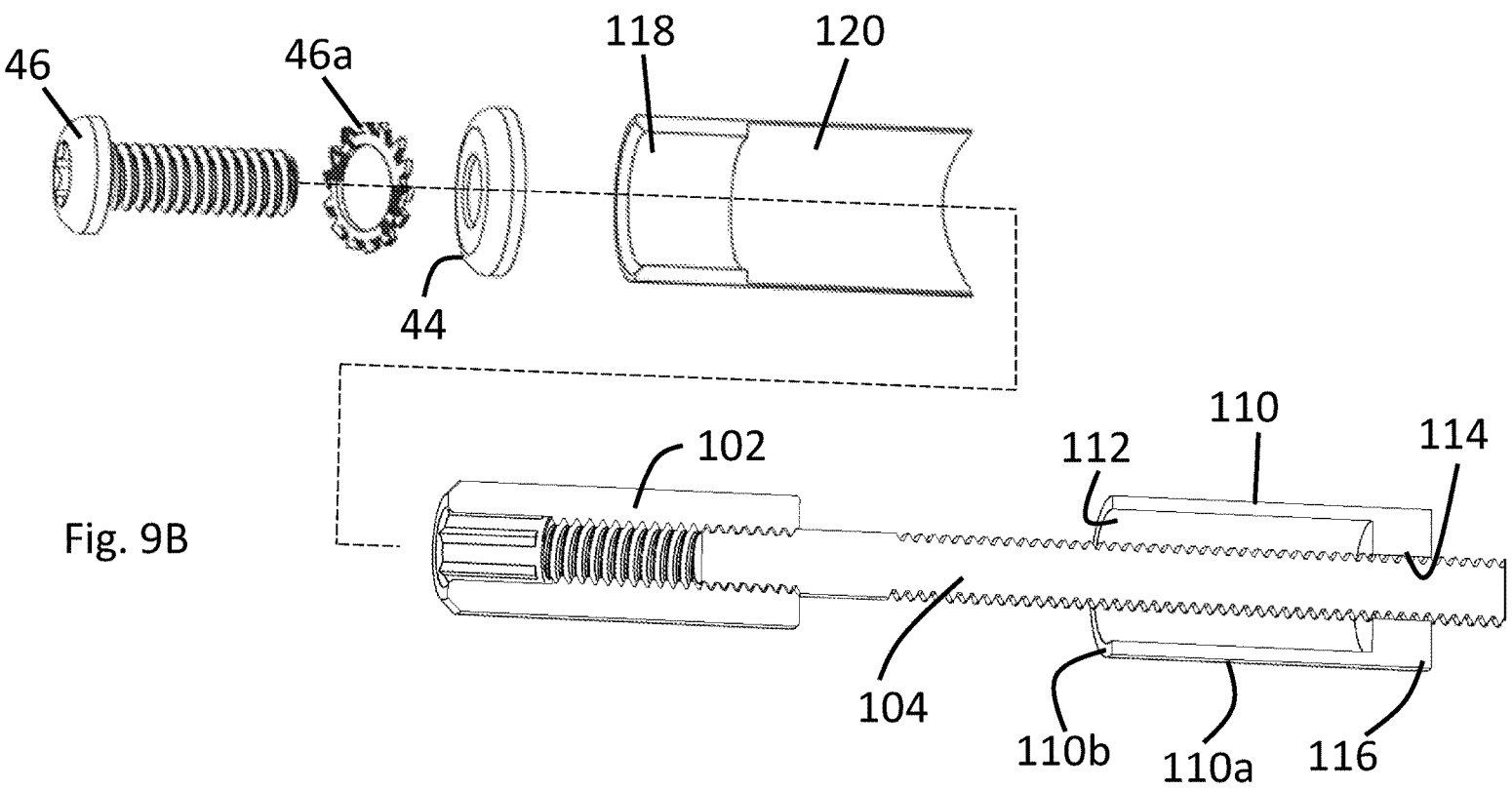
FIG. 9B is an enlarged, exploded view of a grip attachment portion of the adjustable golf club of FIG. 9A.
Figure 9C:
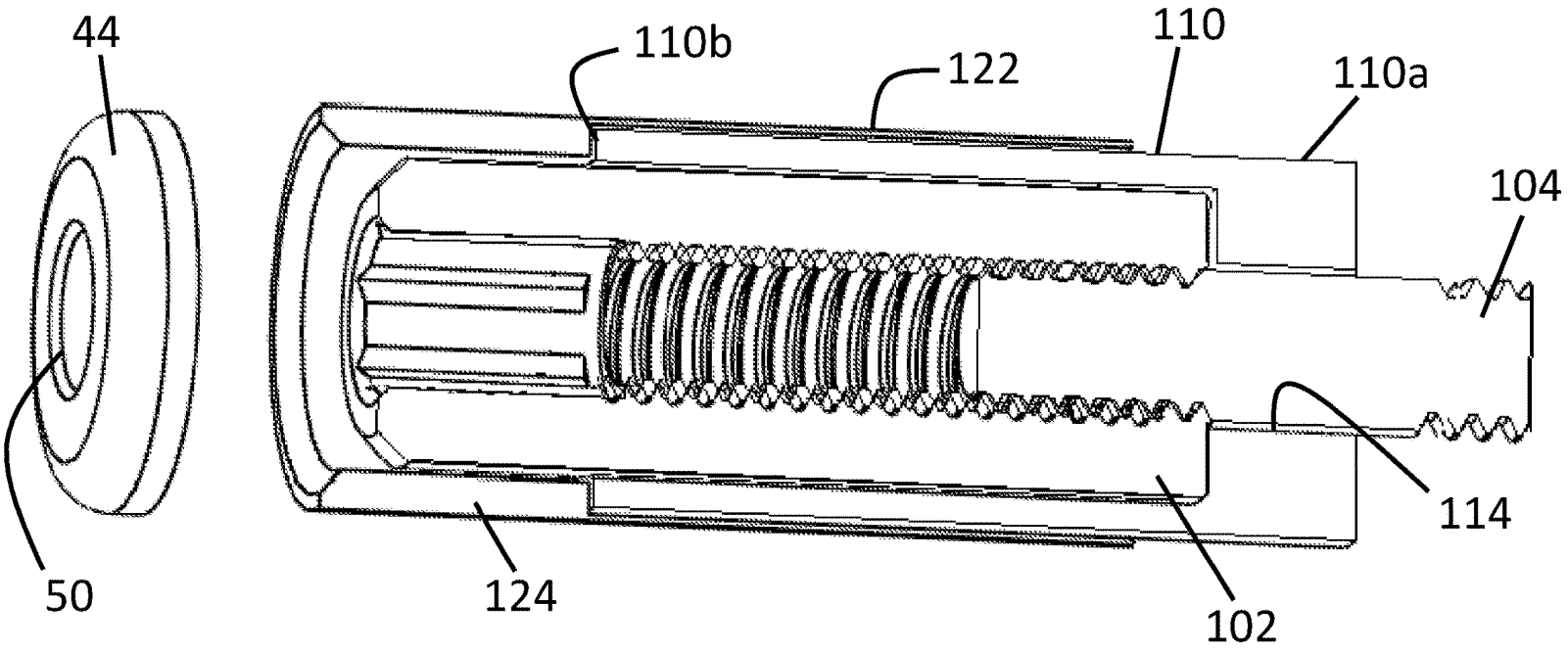
FIG. 9C is an alternative embodiment of a reinforcing sleeve/grip coupling according to the invention.
Figure 9D:
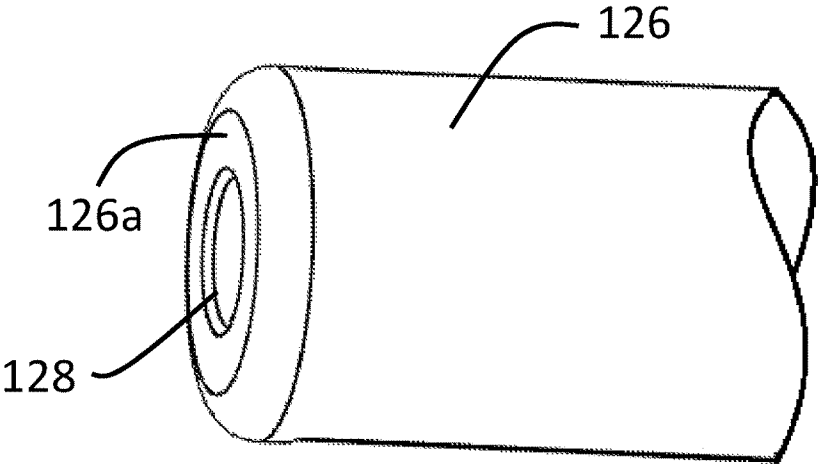
FIG. 9D is another alternative embodiment of a reinforcing sleeve/grip coupling according to the invention.
Figure 10A:
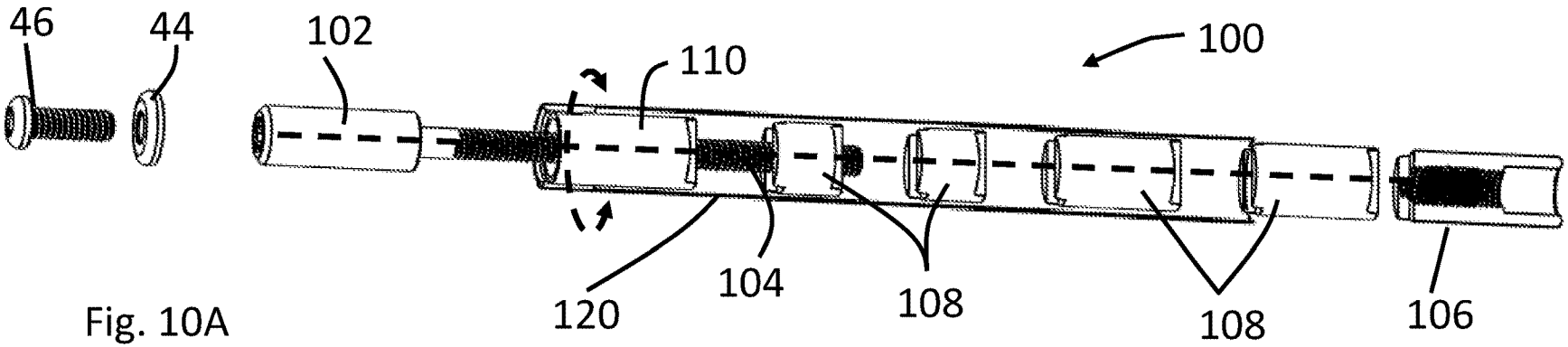
FIG. 10A is an assembly view, exploded and in partial cross section, of the adjustable golf club of FIG. 9A.

Referring now to FIGS. 9A and 9B, there is illustrated an alternative embodiment of a length adjustment kit 100, suitable for any golf club configuration but particularly useful for putter applications. A retaining nut 102, securing rod 104, a shaft adapter 106, and plurality of extension blocks 108 are similarly configured and function as described above in conjunction with similar elements of the embodiments of FIGS. 4A and 4B. A grip adapter 110 is configured with a counterbore 112 and a bore 114 that permits the securing rod to pass through. The grip adapter 110 may also include a boss 116 similar in form and function to boss 28*a* described above. The grip adapter 110 includes a generally smooth and cylindrical outer diameter 110*a* that fits within a complementary-shaped grip coupling 118 shown integrally formed with a reinforcing sleeve 120. As described above, the grip coupling and reinforcing sleeve may be two separate components bonded together. Alternatively, the grip coupling may be a distal end section of the reinforcing sleeve 120 and exhibit the same diameter as the remainder of the reinforcing sleeve or as a necked-down region having substantially the same wall thickness as the rest of the reinforcing sleeve, if desired. The fit between the grip adapter and grip coupling may be a clearance fit or a line-to-line fit to permit relative rotation of the two components as shown in FIG. 10A. The grip coupling or grip adapter may be coated with a material to further facilitate relative rotation and reduce clearances between the assembled interface. Alternatively, the reinforcing sleeve may be configured as a reinforcing sleeve/grip coupling 122 as illustrated in FIG. 9C and include a lip or stop 124 that abuts an end face 110*b* of the grip adapter 110. As shown in FIG. 9D, the reinforcing sleeve may be configured as a reinforcing sleeve/grip coupling 126 with an integrally formed end cap 126*a* and a bore 128, similar to retaining washer 44.

Figure 10B:
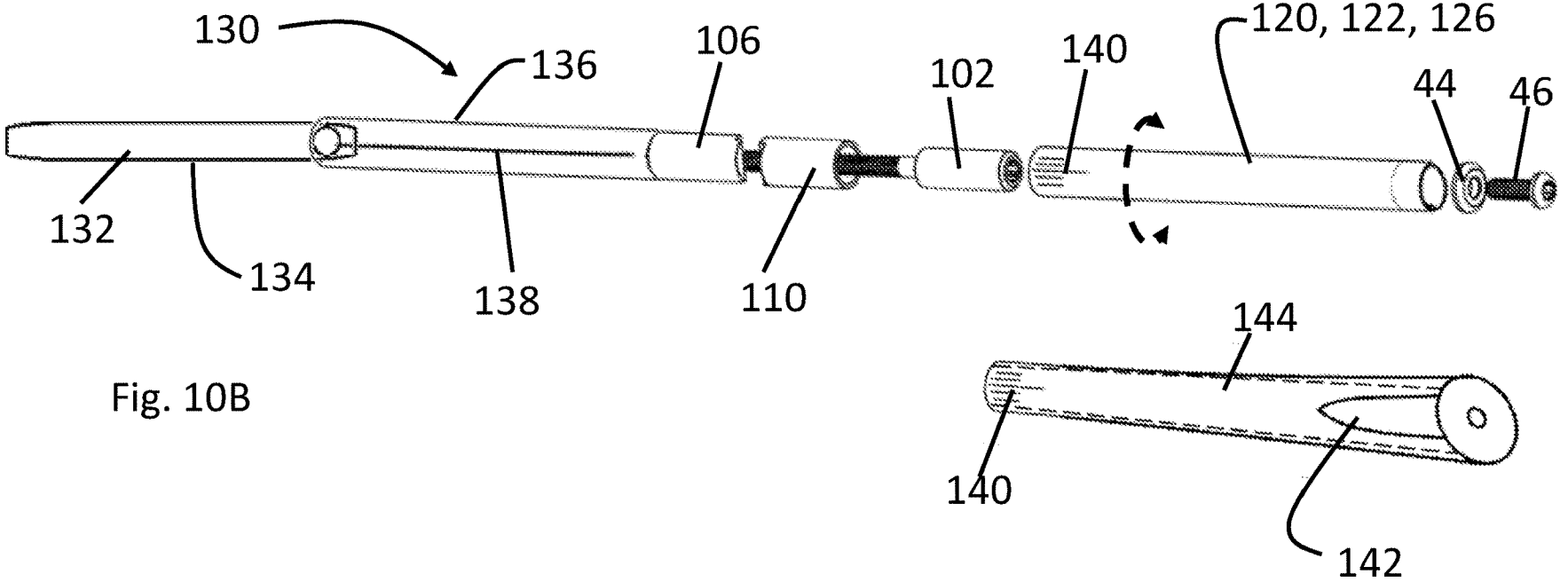
FIG. 10B is an exploded view of the grip attachment of FIG. 9B having grip orientation indicia relative to a club striking face and a shaft reference.

Referring now to FIG. 10B, there is an exemplar golf club assembly configured as a putter and shown generally at 130. The putter 130 includes a putter head 132, illustrated as a blade-style putter head though any known or suitable putter head configuration may be used. The putter head 132 defines a striking face 134 and is attached to a shaft 136 having a head locating reference 138 oriented relative to the striking face 134. In one embodiment, the reinforcing sleeve 120 or reinforcing sleeve/grip coupling 122 or 126 includes a plurality of indicia 140 that orients a flat or handhold indicator area 142 of an attached conventional grip cover (not shown) relative to one of the indicia 140. Alternatively, indicia 140 may be provided on grip cover 144 that is attached to the reinforcing sleeve or reinforcing sleeve/grip coupling. The grip cover can be rotated relative to the shaft and putter head to vary the orientation of the handhold indicator area 142 to the striking face 134. This adjustment permits a golfer to vary the club face to accommodate personal swing variations.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An adjustable golf club comprising:

a club head defining a striking face;

a shaft having a shaft insert supporting a grip adapter, the grip adapter defining a grip adapter profile, the shaft insert including a coupling port that engages a securing rod, the securing rod extending through the grip adapter and terminating in a retaining nut, the retaining nut fixing the grip adapter to the shaft insert; and a grip assembly, having a reinforcing sleeve and a grip coupling, the grip coupling defining a complementary and mating profile with the grip adapter profile such that when mated the grip coupling is configured to be axially moveable relative to the grip adapter; and a fastener restraining axial movement of the grip coupling relative to the grip adapter, the grip assembly configured to be removably secured to the grip adapter.

2. The adjustable golf club of claim 1 wherein the grip adapter profile is a torque resistive profile.

3. The adjustable golf club of claim 2 wherein the torque resistive profile is configured as one of a hexagon, a square, a toothed spline, or a lobed spline.

4. The adjustable golf club of claim 1 wherein the grip adapter profile permits an angular indexing of the grip assembly relative to the striking face.

5. The adjustable golf club of claim 4 wherein the grip assembly includes a grip cover having a handhold indicator area, and wherein one of the reinforcing sleeve or the grip cover includes a plurality of indicia to align the handhold indicator area relative to the striking face.

6. The adjustable golf club of claim 5 wherein the shaft includes a head locating reference that is aligned with the striking face and positioned proximate to at least one of the plurality of indicia.

7. The adjustable golf club of claim 1 wherein at least one extension block is disposed over the securing rod and retained between the grip adapter and the shaft insert.

8. The adjustable golf club of claim 1 wherein the shaft insert includes a counterbore configured to house at least a portion of the retaining nut.

9. The adjustable golf club of claim 8 wherein the grip adapter profile is a generally smooth and cylindrical outer diameter, and the reinforcing sleeve includes a stop that abuts an end face of the grip adapter.

10. The adjustable golf club of claim 9 wherein a retaining washer cooperates with the fastener to restrain axial movement of the grip coupling relative to the grip adapter.

11. The adjustable golf club of claim 10 wherein the retaining washer is integrally formed with the reinforcing sleeve.

12. The adjustable golf club of claim 3 wherein the club head is configured as one of a driver, a fairway wood, an iron, a pitching wedge, a sand wedge, or a lob wedge.

13. The adjustable golf club of claim 4 wherein the club head is configured as a putter head.

14. The adjustable golf club of claim 2 wherein the grip assembly is a first grip assembly supporting a first grip cover and wherein a second grip assembly supporting a second grip cover is configured to be interchangeable with the first grip assembly.

15. The adjustable golf club of claim 1 wherein the grip adapter includes a counterbore and the grip adapter profile is a torque resistive profile, the retaining nut seating within the counterbore to secure the grip adapter to the shaft insert, the fastener engaging the retaining nut.

16. The adjustable golf club of claim 1 wherein the club head is configured as one of a driver, a fairway wood, an iron, a pitching wedge, a sand wedge, or a lob wedge.

17. The adjustable golf club of claim 1 wherein the club head is configured as a putter.

* * * * *